United States Patent [19]

Cowling

[11] 4,228,845

[45] Oct. 21, 1980

[54] CHILLER WITH MEANS FOR MIXING HOT VAPORS WITH COLD OR REFRIGERATED LIQUID

[75] Inventor: Edgar C. Cowling, Bartlesville, Okla.

[73] Assignee: Phillips Petroleum Company, Bartlesville, Okla.

[21] Appl. No.: 872,705

[22] Filed: Jan. 26, 1978

[51] Int. Cl.[2] ..... F28B 9/04; F28F 9/22

[52] U.S. Cl. ..... 165/1; 62/54; 62/117; 62/196 B; 62/DIG. 21; 165/110; 165/132; 165/159

[58] Field of Search ..... 165/110, 132, 159, 160, 165/161, 11, 135, 1; 62/50, 52, 54, 117, 196 B, DIG. 21

[56] References Cited

U.S. PATENT DOCUMENTS

| | | | |
|---|---|---|---|
| 2,897,838 | 8/1959 | Webber et al. | 165/159 |
| 2,919,903 | 1/1960 | Vautrain et al. | 165/110 |
| 3,026,043 | 3/1962 | Lacy et al. | 165/110 |
| 3,048,373 | 8/1962 | Bauer et al. | 165/161 |
| 3,210,953 | 10/1965 | Reed | 62/54 |
| 3,210,955 | 10/1965 | Anderson et al. | 165/110 |
| 3,241,335 | 3/1966 | Embury | 165/161 |
| 3,270,517 | 9/1966 | Clark | 62/196 B |
| 3,320,758 | 5/1967 | Harper | 165/11 |
| 3,714,790 | 2/1973 | Battey | 62/54 |
| 3,798,918 | 3/1974 | Maher et al. | 62/54 |

FOREIGN PATENT DOCUMENTS

| | | | |
|---|---|---|---|
| 46864 | 3/1888 | Fed. Rep. of Germany | 165/110 |
| 447233 | 3/1968 | Switzerland | 62/117 |

*Primary Examiner*—Sheldon Richter

[57] ABSTRACT

A shell-tube bundle heat exchanger is so arranged as to leave a section within the shell devoid of tubes. Into said section relatively hot vapors are introduced to be mixed with chilling medium within said shell and surrounding said tubes. A baffle means is provided to prevent liquid disturbed by introduction of the vapors from transmitting disturbance to the cooling medium surrounding the tubes. In one embodiment, propane vapors under pressure are introduced under the surface of cold liquid propane in a horizontal gas chiller. A stilling leg or vertical baffle is located between the tubes and the point of introduction of the vapors introduced through a slotted vapor inlet pipe. A liquid level sensing and/or control means is also baffled away from the point of introduction of vapors.

17 Claims, 2 Drawing Figures

CHILLER WITH MEANS FOR MIXING HOT VAPORS WITH COLD OR REFRIGERATED LIQUID

This invention relates to a shell-tube bundle heat exchange method and apparatus. In one of its aspects it relates to such an apparatus adapted for chilling vapors of a refrigerant, e.g., a readily vaporized hydrocarbon such as propane. More particularly it relates to a method and means for introducing hot vapors into the chilling medium surrounding tubes without disturbance of said medium surrounding said tubes.

In one of its concepts the invention provides a method of operation of a shell and tube type heat exchanger designed to receive hot vapors to be chilled by a chilling medium in the exchanger, the exchanger containing cooling tubes in which a fluid or medium introduced into said tubes is cooled by said chilling medium which is introduced into said shell which comprises providing a section within said exchanger shell baffled away from said tubes and introducing hot vapors into the chilling medium in said section. In another of its concepts, a shell and tube type heat exchanger is provided the shell of which has disposed therein a nest of tubes adapted to be cooled by chilling medium within said shell surrounding said tubes. The tubes are positioned and sized to extend within said shell from one end thereof toward but not completely to the other end thereof, leaving a section devoid of any portion of said nest of tubes. An inlet is provided for hot vapors in open communication with said section and there is a baffle in said section disposed between said inlet and said nest of tubes whereby to prevent said vapors from causing disturbance of chilling medium in said shell surrounding said nest of tubes In a further concept of the invention there is provided such an apparatus in which the inlet tube is positioned to be normally submerged in the liquid chilling medium, is capped to prevent outflow from the end thereof but slotted to allow radial flow therefrom. In a further concept the invention provides such an apparatus in which there is a liquid level sensing means and a baffle arrangement between said means and said inlet to prevent disturbance of chilling medium at said sensing means.

It is known in the refrigeration apparatus art to introduce hot compressed vapors bypassed from flow to a condenser into an evaporator in which tubes are located and through which tubes there is circulated a medium to be chilled by liquid refrigerant introduced below said tubes, the hot vapors entering also below said tubes then being distributed below said tubes through a series of plates which are apertured.

It is desirable to provide a design which will avoid the considerable turbulence which ordinarily occurs when running hot, high-pressure gases into a cool liquid. More specifically, it is desired to localize any disturbance of vapor entering the liquid and being condensed thereby to avoid disturbance at the cooling or chilling tubes. Still more specifically it is important not to permit hot gases to blow over the tubes thereby lowering their heat exchange efficiency as will be understood by one skilled in the art of heat transfer.

An object of this invention is to provide a method for mixing hot vapors with a chilling or refrigerating liquid medium. It is another object of this invention to provide a method for mixing hot hydrocarbon vapors with refrigerated liquid hydrocarbon within a shell-tube bundle type heat exchanger. It is a further object of this invention to provide an apparatus of the shell-tube bundle type in which hot vapors can be admixed with liquid surrounding a nest of tubes therein without causing disturbance of the liquid in said heat exchanger. It is a further object of the invention to improve the heat transfer from chilling medium to tubes located in a shell-tube bundle type heat exchanger into which there is also introduced a stream of hot vapors, as in connection with a compressor, refrigeration and chilling evaporator, condenser apparatus.

Other aspects, concepts, objects and the several advantages of the invention are apparent from a study of this disclosure, the drawing and the appended claims.

According to the present invention there is provided in a shell-tube bundle heat exchanger a section in which chilling medium therein contained can be suitably admixed with hot vapors being fed to said heat exchanger without, however, disturbing liquid surrounding said tubes the heat transfer efficiency of which is to be maintained. Further, according to the invention in a shell-tube bundle type heat exchanger structure chilling tubes are provided extending from one end toward but not completely to the other end thereof thus to leave a section not containing any portion of said tubes. There is also provided a vapor inlet pipe or distribution means located within said section and a baffle or disturbance quieting means located between said inlet and said tubes.

Further according to the invention a liquid level control or sensing means is located at said other end of the apparatus. Also, between said sensing means extending into said apparatus and said inlet there is located a disturbance quieting means or baffle to prevent disturbed liquid, which may contain some bubbles of vapor, from flowing towards said liquid level sensing means.

Still further according to the invention the totality of baffle or disturbance quieting means is so arranged that net flow of liquid will be upwardly toward the surface of the liquid and away from said liquid sensing means, as by having baffles or other structures of different heights, the top of the baffle at the tube side of the inlet being below the surface of the liquid but above the top of the tubes and the top of the baffle at the liquid sensing means side of the inlet being, preferably, above the surface of the liquid.

The baffles or disturbance quieting means are sometimes referred to as stilling legs.

The invention is particularly applicable to solving a problem which arises in providing low temperature gas for suction pressure maintenance to a propane or other liquid refrigerant compressor of a refrigeration system. The problem arises when attempting to cool down the hot high pressure gas that is recycled ultimately to the compressor suction. Usually, this gas is passed into contact with a chilling medium. In passing into and through the chilling medium a cooled or chilled vapor is obtained suitable for recycle to the compressor suction.

In a prior design the vapor blows onto the tubes, albeit it passes through an apertured plate.

According to this invention, the stilling legs are designed to prevent hot vapor from blowing on the tubes, also to restrict the large surges in liquid level which can occur to a small area away from the level controller and away from the tubes at all times.

Usually, the stilling legs are arranged to have a shape and size such that while the disturbance created by the hot vapor entering into the chilling medium or when there is a surge will not be communicated by way of the liquid to the tubes or for that matter to the liquid sensing means. Nevertheless, the quieting means or stilling legs or baffles are shaped to permit flow of liquid around an edge or edges thereof. Accordingly, in the invention the shape of the stilling legs is such as to provide adequate liquid flow within the shell of the apparatus, yet to prevent flow of disturbed liquid to the tubes or to the sensing means thus to interfere with the most efficient operation thereof.

In the drawing

Figure 1:
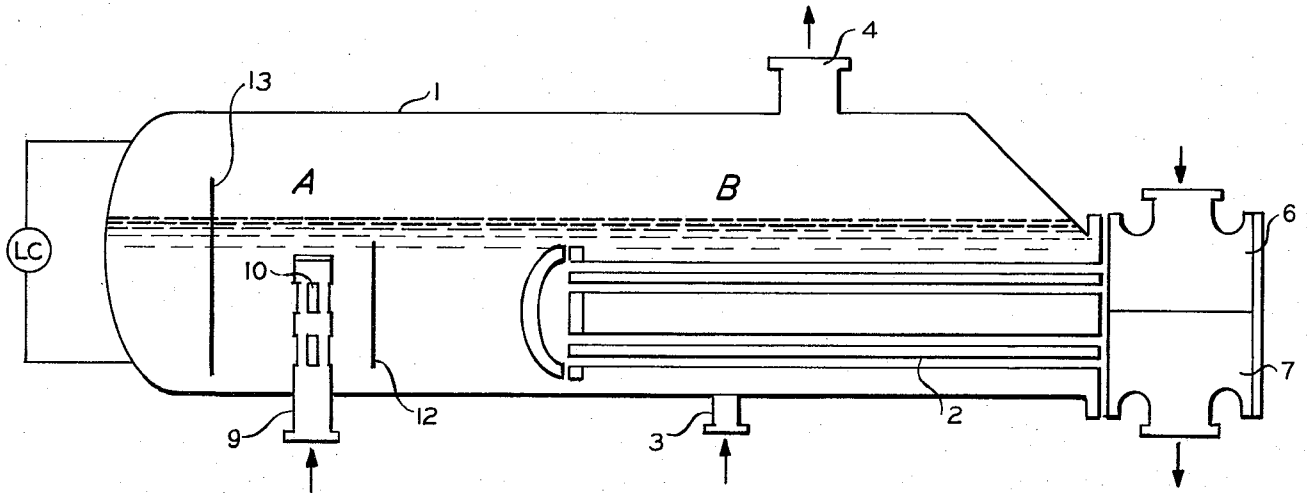
FIG. 1 is an elevational cross-sectional view taken along the length of an apparatus embodiment of the invention.

Referring now to FIG. 1, in shell 1 are disposed chilling tubes 2 which are chilled by propane or other liquid refrigerant introduced at 3. Propane vapor is removed at 4 from shell 1. Fluids to be chilled, in this case hydrocarbon vapors and liquids, are passed to the tube inlet 6 through tubes 2 and through outlet 7.

Figure 2:
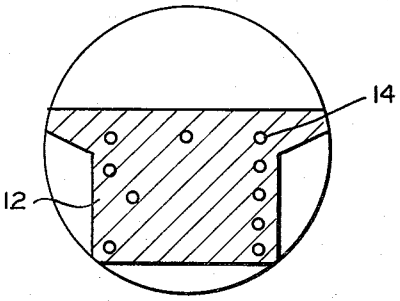
FIG. 2 is an elevational cross-section across the length of the apparatus at baffle 12.

Hot high pressure vaporous propane enters inlet pipe 9 and from the pipe emerges through slots 10 into section A of shell 1. As shown, the slots 10 are below the normal liquid level maintained in shell 1. The top of pipe 9 is suitably capped in this embodiment. Stilling legs 12 and 13 are provided in this embodiment, being shaped as shown in FIG. 2 in which a face view of baffle 12 is shown as viewed from an end of shell 1. Baffle 12 can be at least in part perforated to permit some flow therethrough as at the edges thereof. The perforations are shown at 14.

It will be noted that the top edge of stilling leg 12 is below the normal surface of the liquid, whereas the top edge of stilling leg 13 is above the surface, thus generally tending to cause liquid disturbed by said hot vaporous propane to flow upwardly and over stilling leg 12 toward section B and the surface of the liquid well above tubes 2.

Such an apparatus and operation as here described is useful in a cascade refrigeration system in which, say, refrigerant is used to cool and partially condense a gas stream such as natural gas.

In the operation of a refrigeration compressor it is sometimes desirable to return cooled vapors to the suction thereof. This is especially desired under low low operation so that the compressor can work against a good supply of medium to be compressed.

Reasonable variation or modification are possible within the scope of the foregoing disclosure, drawing and the appended claims to the invention, the essence of which is that there have been provided a method and apparatus, substantially as described wherein hot vapors to be chilled, as prior to return to a compressor suction in a refrigeration system, are passed into liquid chilling medium in a section of a shell-tube bundle heat exchanger in a manner to prevent disturbance there caused from extending to tubes located therein and/or to a liquid sensing device also located therein.

What is claimed is:

1. A method for admixing a chilling liquid medium, being used to chill a nest of tubes in a shell and tube type heat exchanger, and a hot vapor introduced into said chilling medium, which comprises disposing said exchanger in a substantially horizontal position and having said tubes extend only a portion of the length of said shell, introducing chilling liquid medium into said shell into direct contact with said tubes, maintaining a level of said liquid in said exchanger sufficient to cover said tubes but such that a vapor collecting space exists above said level so that vapor from said liquid can be collected from said surface and removed from said shell at a upper locus thereof, providing in such shell a hot vapor receiving section horizontally removed and baffled away from said tubes by a baffle extending from a low point in said liquid medium to a level above said tubes, but below the level of the surface of said liquid medium and introducing said hot vapors directly into said liquid in said section, whereby a mixture of hot vapors and liquid formed in said section overflows the top of said baffle into the surface of the liquid substantially above said tubes.

2. A method for admixing a chilling liquid medium, being used to chill a nest of tubes in a shell and tube type heat exchanger, and a hot vapor introduced into said chilling medium, which comprises disposing said exchanger in a substantially horizontal position and having said tubes extend only a portion of the length of said shell, introducing chilling liquid medium into said shell into direct contact with said tubes, maintaining a level of said liquid in said exchanger sufficient to cover said tubes but such that a vapor collecting space exists above said level so that vapor from said liquid can be collected from said surface and removed from said shell at a upper locus thereof, providing in such shell a hot vapor receiving section horizontally removed and baffled away from said tubes by a baffle extending from a low point in said liquid medium to a level above said tubes, but below the level of the surface of said liquid medium and introducing said hot vapors into said liquid in said section, whereby a mixture of hot vapors and liquid formed in said section overflows the top of said baffle into the surface of the liquid substantially above said tubes; and wherein there is provided in said shell baffled away from said hot vapor receiving section a liquid level sensing and maintaining section which maintains said level of said liquid in said exchanger sufficient to cover said tubes and to maintain said vapor collecting space.

3. A method for introducing hot vapors into a horizontally disposed elongated shell and tube type heat exchanger adapted to receive hot vapors to be chilled by a chilling medium in the exchanger, said exchanger containing cooling tubes extending from an end portion of said exchanger and in which a fluid introduced into said tubes is cooled by chilling medium which is introduced through an inlet at said end portion of said exchanger into said shell directly into contact with said tubes, comprising providing a section within said exchanger shell at the other end thereof horizontally removed from said tubes and baffled away from said tubes, providing a hot vapors inlet to said section and introducing the hot vapors substantially upwardly directly into said chilling medium in said section whereby the disturbance of chilling medium in said shell surrounding said tubes is prevented.

4. A method according to claim 1 wherein the level of the chilling medium in said shell is controlled to substantially submerge said tubes but to provide a vapor collecting space above the surface of said chilling medium in said shell.

5. A method according to claim 4 wherein the liquid chilling medium in said shell is propane and said hot vapor is hot high pressure vapor propane.

6. A method according to claim 5 where the admixture formed by the hot propane vapor which has been introduced into said chilling propane is caused to flow upwardly toward the surface of the chilling medium in said shell at a level above said tubes thus to more completely avoid disturbance of the chilling medium in contact with said tubes being chilled thereby.

7. A shell and tube type heat exchanger, said shell being substantially horizontally disposed and having positioned therein a nest of tubes, chilling introducing means for introducing chilling medium into said shell into contact with said tubes, said tubes being adapted to be cooled directly by chilling medium introduced to within said shell through said introducing means to surround said tubes, said tubes extending within said shell from one end portion thereof toward but not completely to the other end thereof leaving a section at the other end of said shell not containing any portion of said nest of tubes, means for maintaining said tubes substantially submerged in chilling medium liquid within said shell and a level of liquid surrounding said tubes below the upper portion of said shell to provide a vapor removal and collection from the surface of said liquid, an inlet for hot vapors in direct open communication with said section at said other end of said shell adapted for the direct introduction of vapor into liquid in said section and a baffle in said section disposed between said inlet and said nest of tubes whereby to prevent any of said hot vapors from causing disturbance of chilling medium in said shell surrounding said tubes.

8. An apparatus according to claim 7 wherein said baffle extends toward but not completely to the inner wall of said shell.

9. An apparatus according to claim 7 wherein the baffle is shaped relative to the shell wall and said tubes to permit flow of liquid thereover and around the remaining edges thereof.

10. Apparatus according to claim 9 wherein the baffle is at least in part perforated to permit some flow therethrough as at the edges thereof.

11. A heat exchanger according to claim 7 wherein the inlet extends into said shell a substantial distance adjacent said nest of tubes and the baffle extends over an area sufficient between said inlet and said nest of tubes to prevent said disturbance.

12. A heat exchanger according to claim 11 wherein said baffle is substantially vertically disposed within said shell, at its upper end is shaped to cause upwardly flowing mixture of hot vapors and chilling medium to flow over the top edge thereof and at a bottom portion is so shaped as to provide for flow of chilling medium into said section.

13. An apparatus according to claim 11 wherein the inlet is an apertured pipe.

14. An apparatus according to claim 13 wherein said pipe is slotted.

15. A shell and tube type heat exchanger, said shell being substantially horizontally disposed and having positioned therein a nest of tubes adapted to be cooled by chilling medium within said shell surrounding said tubes, said tubes extending within said shell from one end thereof toward but not completely to the other end thereof leaving a section not containing any portion of said nest of tubes, means for maintaining said tubes substantially submerged in chilling medium liquid within said shell and a level of liquid surrounding said tubes below the upper portion of said shell to provide a vapor removal and collection from the surface of said liquid, an inlet for hot vapors in open communication with said section and a first baffle in said section disposed between said inlet and said nest of tubes whereby to prevent any of said hot vapors from causing disturbance of chilling medium in said shell surrounding said tubes, a second baffle between said other end and said inlet, and a level sensing means between said second baffle and said other end.

16. An apparatus according to claim 15 wherein the second baffle between said level sensing means is larger than that between said inlet and said nest of tubes to prevent flow of mixed vapors and liquid toward said level sensing means and to urge flow generally upwardly into the surface of the liquid well above and over the tubes.

17. An apparatus according to claim 15 wherein said inlet for hot vapors extends upwardly into said section, is capped at its upper end, apertured to permit hot vapors to emanate therefrom into the liquid in said shell and said apertures are located at a level below the top of said first baffle.

* * * * *